United States Patent [19]

Ohishi

[11] Patent Number: 4,771,753

[45] Date of Patent: Sep. 20, 1988

[54] AIR-FUEL RATIO CONTROL SYSTEM FOR AN AUTOMOTIVE ENGINE

[75] Inventor: Hiroshi Ohishi, Hoya, Japan

[73] Assignee: Fuji Jukogyo Kabushiki Kaisha, Tokyo, Japan

[21] Appl. No.: 82,858

[22] Filed: Aug. 5, 1987

[30] Foreign Application Priority Data

Aug. 13, 1986 [JP] Japan ..... 61-191016

[51] Int. Cl.[4] ..... F02D 41/14

[52] U.S. Cl. ..... 123/489; 123/440

[58] Field of Search ..... 123/440, 489

[56] References Cited

U.S. PATENT DOCUMENTS

| | | | |
|---|---|---|---|
| 4,445,481 | 5/1984 | Aoki et al. | 123/440 |
| 4,461,261 | 7/1984 | Isomura et al. | 123/489 |
| 4,530,333 | 7/1985 | Nishimura | 123/489 |
| 4,545,355 | 10/1985 | Takao et al. | 123/489 |
| 4,625,699 | 12/1986 | Kobayashi et al. | 123/489 |

FOREIGN PATENT DOCUMENTS 122135 7/1982 Japan .

*Primary Examiner*—Tony M. Argenbright

*Attorney, Agent, or Firm*—Martin A. Farber

[57] ABSTRACT

A first lookup table is provided for storing a plurality of basic fuel injection pulse widths from which one of pulse widths is derived in accordance with engine speed and intake-air pressure. A second lookup table is provided for storing a plurality of maximum correcting quantities for correcting a derived basic fuel injection pulse width in order to correct deviation of air-fuel ratio due to change of valve clearance of the engine. A necessary correcting quantity is obtained by multiplying a learning coefficient and a derived maximum correcting quantity. A desired fuel injection pulse width is obtained by adding the necessary correcting quantity to the derived basic fuel injection pulse width. The learning coefficient is updated by ½ at every updating.

4 Claims, 5 Drawing Sheets

FIG. 1
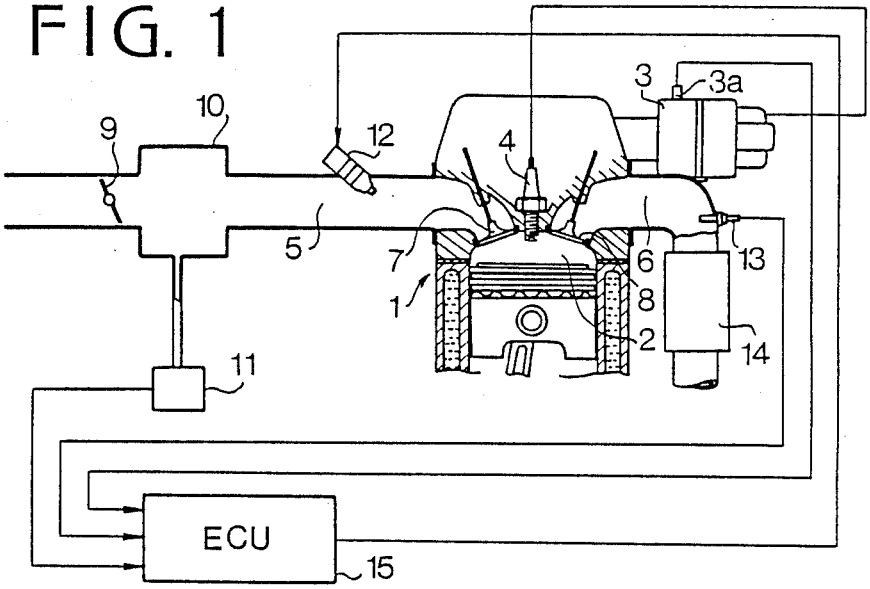
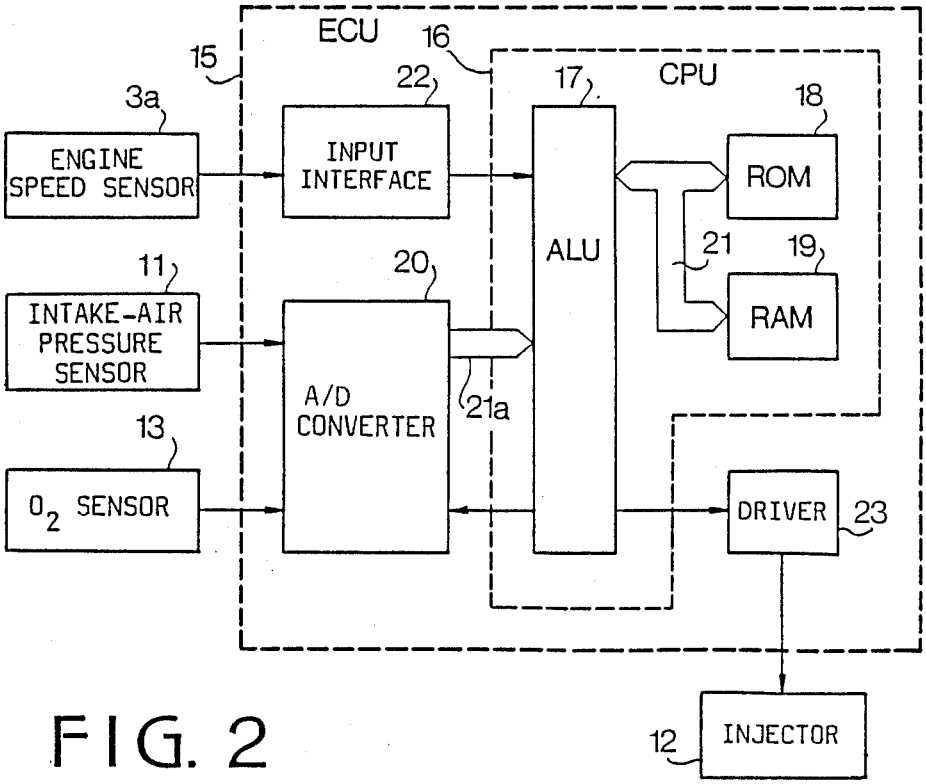
FIG. 2

AIR-FUEL RATIO CONTROL SYSTEM FOR AN AUTOMOTIVE ENGINE

BACKGROUND OF THE INVENTION

The present invention relates to an air-fuel ratio control system for an engine of a motor vehicle, and more particularly to a system having an electronic fuel injection system controlled by learning control.

In one type of electronic fuel-injection control, the quantity of fuel to be injected into the engine is determined in accordance with engine operating variables such as mass air flow, intake-air pressure, engine load and engine speed. The quantity of fuel is determined by a fuel injector energization time (injection pulse width).

Generally, a desired injection amount is obtained by correcting a basic quantity of injection with various correction or compensation coefficients of engine operating variables. The basic injection pulse width is derived from a lookup table to provide a desired (stoichiometric) air-fuel ratio according to mass air flow or intake-air pressure and engine speed. The basic injection pulse width $T_P$ is expressed, for example, as follows.

$$T_P = f(P, N)$$

where P is intake-air pressure and N is engine speed.

Desired injection pulse width (T) is obtained by correcting the basic injection pulse $T_P$ with coefficients for engine operating variables. The following is an example of an equation for computing the actual injection pulse width.

$$T = T_P \times K \times \alpha \times Ka$$

where K is at least one of coefficient selected from various coefficients such as coefficients on coolant temperature, full throttle, etc., $\alpha$ is a feedback correcting coefficient which is obtained from output signal of an $O_2$-sensor provided in an exhaust passage, and Ka is a correcting coefficient by learning (hereinafter called learning control coefficient) for compensating the change of characteristics of devices with time in the fuel control system such as, injectors and an intake air pressure sensor, due to deterioration thereof. The coefficients K and Ka are stored in lookup tables and derived from the tables in accordance with sensed informations.

The control system compares the output signal of the $O_2$-sensor with a reference value corresponding to desired air-fuel ratio and determines the feedback coefficient $\alpha$ so as to converge air-fuel ratio of air-fuel mixture to the desired air-fuel ratio.

As described above, the basic injection pulse width $T_P$ is determined by the intake-air pressure P and engine speed N. However, the intake-air pressure is not always constant, even if the engine speed is the same as previous speed. For example, when a valve clearance (the clearance between an intake (or exhaust) valve-stem tip and a rocker arm) becomes large with time, the valve opening time becomes short. As a result, overlapping times of the intake valve opening time and the exhaust valve opening time become short. Accordingly, quantity of exhaust gas inducted into an intake passage from a combustion chamber during the overlapping time becomes small. Thus, quantity of the intake-air increases. However, the intake-air pressure and hence quantity of fuel injection do not change. Accordingly, the air-fuel ratio becomes large (lean air-fuel mixture). The same result occurs when driving at high altitude.

Such a change of characteristic of a device is also corrected by updating a learning control coefficient. In a prior art, for example U.S. Pat. No. 4,445,481, the learning control coefficient is updated little by little. Accordingly, it takes long time to get a desired coefficient, which causes the delay of control of air-fuel ratio.

SUMMARY OF THE INVENTION

The object of the present invention is to provide an air-fuel ratio control system for an automotive engine which may promptly control the air-fuel ratio to a desired air-fuel ratio, thereby improving driveability of a vehicle.

According to the present invention, there is provided an air-fuel ratio control system for an automotive engine comprising, an $O_2$-sensor for detecting oxygen concentration of exhaust gas and for producing a feedback signal, first means responsive to the feedback signal for producing an air-fuel ratio signal, second means for producing a deviation signal representing the air-fuel ratio dependent on the air-fuel ratio signal from a desired air-fuel ratio, a first lookup table storing a plurality of basic fuel injection pulse widths from which one of pulse widths is derived in accordance with engine operating conditions, a second lookup table storing a plurality of maximum correcting quantities for correcting a derived basic fuel injection pulse width in order to correct deviation of air-fuel ratio due to change of a characteristic of a device used in the engine, third means for producing a necessary correcting quantity by multiplying a learning coefficient and a derived maximum correcting quantity, fourth means for producing a desired fuel injection pulse width in accordance with the necessary correcting quantity and the derived basic fuel injection pulse width, fifth means for updating the learning coefficient with a correcting value when deviation represented by said deviation signal is out of an allowable range, said correcting value being gradually reduced at every updating.

The other objects and features of this invention will be apparently understood from the following description with reference to the accompanying drawings.

BRIEF DESCRIPTION OF DRAWINGS

FIG. 1 is a schematic diagram showing a system to which the present invention is applied;

FIG. 2 is a block diagram showing a control system;

DETAILED DESCRIPTION OF THE PREFERRED EMBODIMENT

Figure 3:
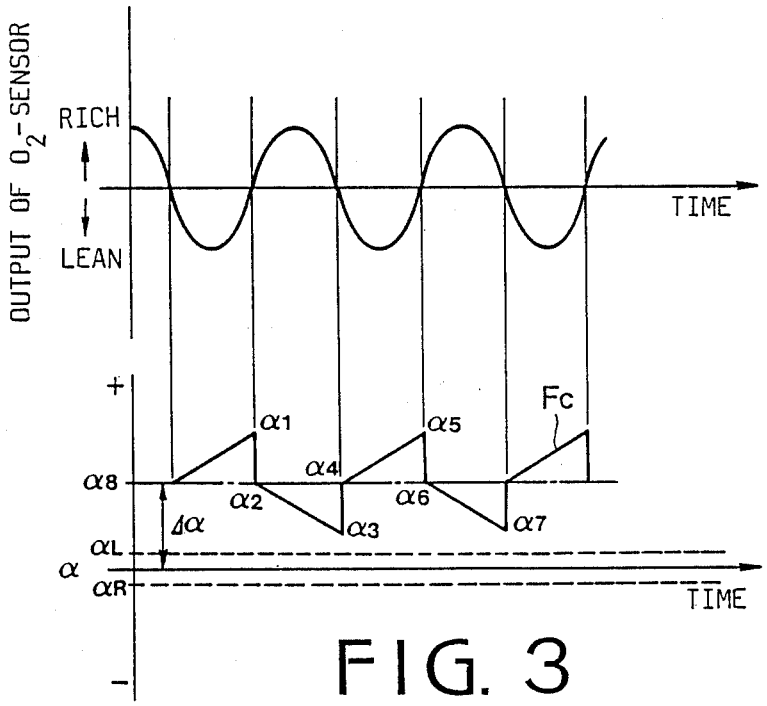
FIG. 3 shows graphs showing output voltages of an $O_2$-sensor and output voltage of a proportional and integrating circuit (hereinafter called PI circuit)

Referring to FIG. 1, an engine has a cylinder 1, a combustion chamber 2, and a spark plug 4 connected to a distributor 3. An engine speed sensor 3*a* is provided on the distributor 3. An intake passage 5 is communicated with the combustion chamber 2 through an intake valve 7 and an exhaust passage 6 is communicated with the combustion chamber 2 through an exhaust valve 8. In an intake passage 5 of the engine, a throttle chamber 10 is provided downstream of a throttle valve 9 so as to absorb the pulsation of intake-air. A pressure sensor 11 is provided for detecting the pressure of intake-air in the chamber 10 and for producing an intake-air pressure signal. Multiple fuel injectors 12 are provided in the intake passage 5 at adjacent positions of intake valve 7 so as to supply fuel to each cylinder 1 of the engine. An $O_2$-sensor 13 and a catalytic converter 14 are provided in the exhaust passage 6. The $O_2$-sensor 13 is provided for detecting concentration of oxygen in exhaust gases in the exhaust passage 6.

Output signals from the pressure sensor 11 and the $O_2$-sensor 13 are supplied to an electronic control unit (ECU) 15 consisting of a michrocomputer. The engine speed sensor **3*a* produces an engine speed signal which is fed to the control unit 15. The control unit 15 determines a quantity of fuel injected from the injectors 12 and supplies a signal to injectors 12**.

Referring to FIG. 2, the electronic control unit 15 comprises a central processor unit (CPU) 16 having an arithmetic and logic circuit (ALU) 17, a read only memory (ROM) 18, and a random access memory (RAM) 19. The ALU 17, ROM 18, and RAM 19 are connected to each other through a bus line 21. An A/D converter 20 is connected to the ALU 17 through a bus line **21*a*. A sample-hold signal is applied to the A/D converter 20 from the ALU 17. The A/D converter 20 is supplied with analog voltage signals from the pressure sensor 11 and $O_2$-sensor 13 to convert the analog voltage signal into a digital signal. An input interface 22 combined with a waveform shaping circuit is supplied with the engine speed signal from engine speed sensor 3*a* for shaping waveforms of the signal. An output signal of the interface 22 is supplied to ALU 17. A driver 23 produces a pulse signal for driving the injectors 12**.

The engine speed signal from the input interface 22 and the intake-air pressure signal from the A/D converter 20 are stored in the RAM 19 through the ALU 17. The air-fuel ratio signal from the A/D converter 20 is compared with a reference voltage signal corresponding to a desired air-fuel ratio at the CPU 16 at regular intervals. When the air-fuel mixture supplied to the engine is rich compared with the desired air-fuel ratio, a "1" signal is stored in the RAM 19. When the air-fuel mixture is lean, a "0" signal is stored in the RAM 19. The fuel injection pulse width T is calculated based on the stored data in the RAM 19 and maps 24 and 25 (FIG. 5) stored in the ROM 18 for driving the injectors 12 as described hereinafter. The map 24 is for the basic fuel injection pulse width $T_P$ when the valve mechanism has a normal valve clearance. The map 25 stores maximum correcting quantities CLRN for the valve clearance. Each correcting quantity CLRN is a maximum limit value for enriching the mixture. The data $T_P$ and CLRN are derived from the maps 24, 25 dependent on the intake-air pressure P and the engine speed N.

Figure 5:
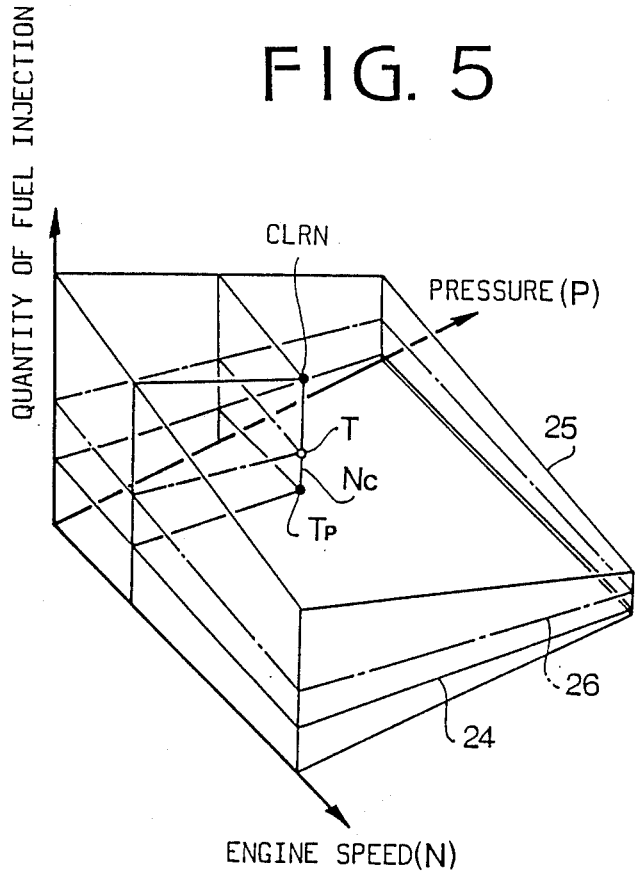
FIG. 5 is an illustration showing maps for quantity of fuel injection.

Although the maps 24 and 25 are superimposed in FIG. 5 for the convenience of explanation, both maps are provided in individual divisions of ROM 18.

The ALU 17 executes arithmetic processes by reading "1" and "0" data stored in the RAM 19 at regular intervals, as described hereinafter.

As shown in FIG. 3, the air-fuel ratio signal from the $O_2$-sensor 13 changes cyclically over the reference valve to rich and lean sides. The ALU 17 produces a feedback correcting signal Fc. When the data changes from "0" to "1", the signal Fc skips in the negative direction (from $\alpha 1$ to $\alpha 2$).

Thereafter, the value of the signal Fc is decremented with a predetermined value at regular intervals. When the data changes from "1" to "0", the signal Fc skips in the positive direction (from $\alpha 3$ to $\alpha 4$), and is incremented with the predetermined value. Thus, the singal Fc has a saw teeth wave as shown in FIG. 3.

In the system, the desired fuel injection pulse width T is obtained by adding a necessary correcting quantity NC to the basic injection pulse width $T_p$. The correcting quantity NC is obtained by multiplying the correcting quantity CLRN by a learning coefficient Kb. Namely the learning coefficient Kb is a rate for obtaining a proper correcting quantity NC from correcting quantity CLRN. The learning coefficient Kb is, for example, 0.5 and is corrected little by little as the learning operation continues. Thus, the desired fuel injection pulse width T is $$T = T_p + CLRN \times Kb \ (0 \leqq Kb \leqq 1)$$

Aforementioned coefficients K, Ka and $\alpha$ are omitted from the equation. Thus, in the system, the desired injection pulse width T in the entire operating range according to the intake-air pressure P and engine speed N is obtained by using only one coefficient Kb.

Figure 6:
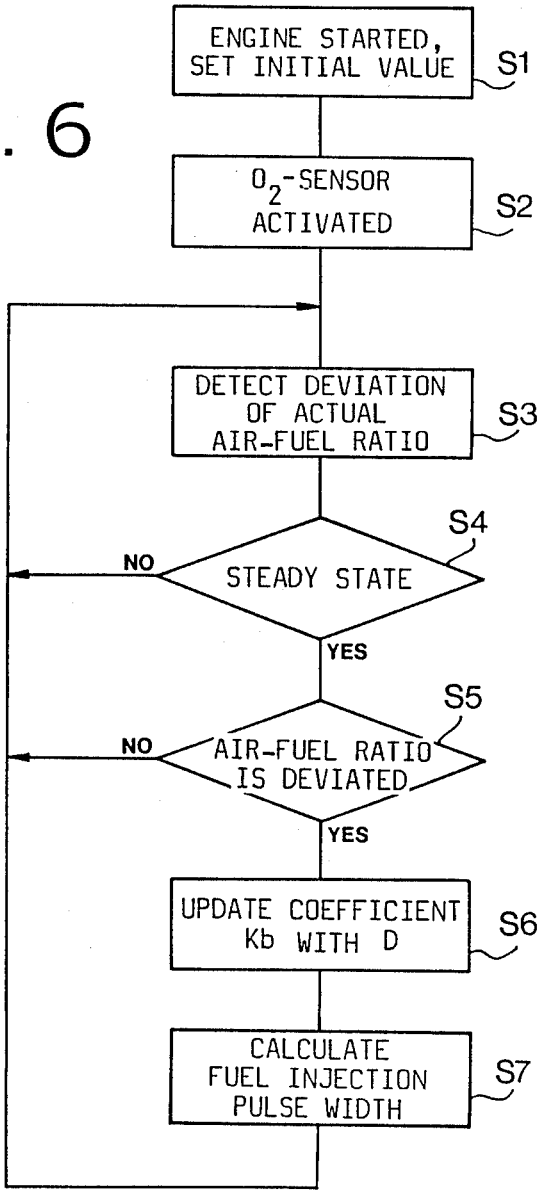
FIG. 6 is a flowchart showing the operation of the system.

Referring to FIG. 6, the operation of the system will be described in more detail.

At starting of the engine at a step S1, a learning coefficient Kb is initially set to 0.5. The desired fuel injection pulse width T is obtained by calculating the above equation.

When the engine is warmed up and the $O_2$-sensor 13 becomes activated, the program proceeds to a step S2 to start a feedback control operation. Average value $\alpha 8$ of the feedback correcting signal Fc from the $O_2$-sensor 13 for a period during four times of skipping of signal Fc is obtained as an arithmetical average of maximum values $\alpha 1$, $\alpha 5$ and minimum values $\alpha 3$, $\alpha 7$.

At a step S3, the average value $\alpha 8$ is compared with a desired air-fuel ratio $\alpha 0$ to obtain a deviation value $\Delta\alpha$.

Figure 4:
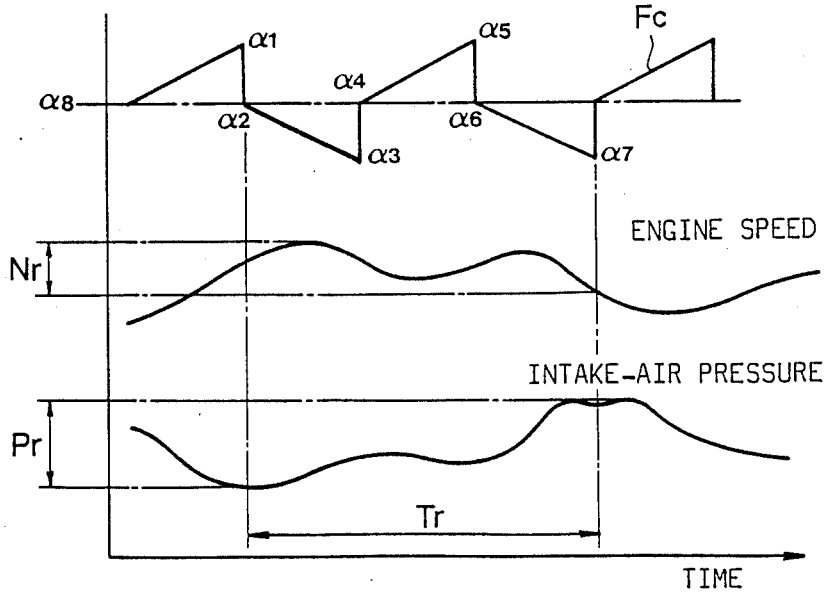
FIG. 4 is a graph showing relationship between output voltage of the PI circuit and variation ranges of engine speed and intake-air pressure.

The engine operating condition is detected at a step S4 whether the engine is in a steady state or not. As shown in FIG. 4, the steady state is decided by ranges Pr and Nr of variations of intake-air pressure and engine speed for a period Tr of the four times of the skipping. The maximum values and the minimum values of the engine speed N and the intake-air pressure P are obtained. The variation ranges Nr and Pr of the engine speed N and the intake-air pressure P for the period Tr are obtained from the differences between maximum and minimum values thereof respectively.

If those variation ranges are within set ranges, the engine operation is regarded as being in the steady state, and the program proceeds to a step S5. If those ranges are out of the set ranges, the program returns to the step S3.

At step S5, it is determined whether the deviation $\Delta\alpha$ is within a predetermined allowable range ($\alpha R \leqq \Delta\alpha \leqq \alpha L$), or out of the range. If the deviation $\Delta\alpha$ is out of the range, the program proceeds to a step S6. At the step S6, the learning coefficient Kb is updated as described hereinafter.

If the deviation is within the range, the program returns to the step S3.

When the deviation $\Delta\alpha$ is larger than the value of maximum lean air-fuel mixture $\alpha L$ ($\Delta\alpha > \alpha L$), learning coefficient Kb is rewritten at the first learning to a first learning coefficient Kb1 with a correcting value D=1/22, as follows.

$$Kb1 = Kb + (1/22)$$

However, if the deviation $\Delta\alpha$ is still larger than the lean value $\alpha L$ at the second learning, a second learning coefficient Kb2 is obtained by $$Kb2 = Kb1 + (1/23)$$

To the contrary, when the deviation is smaller than the value of rich air-fuel mixture $\alpha R$ ($\Delta\alpha > \alpha R$) at the first learning, a first learning coefficient Kb1 is obtained, as follows.

$$Kb1 = Kb - (1/22)$$

At the second learning, if the deviation $\Delta\alpha$ is still smaller than the rich value $\alpha R$, a second learning coefficient Kb2 is given by $$Kb2 = Kb1 - (1/23)$$

Accordingly, a learning coefficient Kn at n times of learning is given by $$Kbn = Kb_{n-1} \pm (\tfrac{1}{2}n + 1)$$

When the correcting value (D) becomes 1/26 for the fifth learning coefficient Kb5, the correcting value (D) after the fifth learning is fixed to the value of 1/26.

Figure 7:
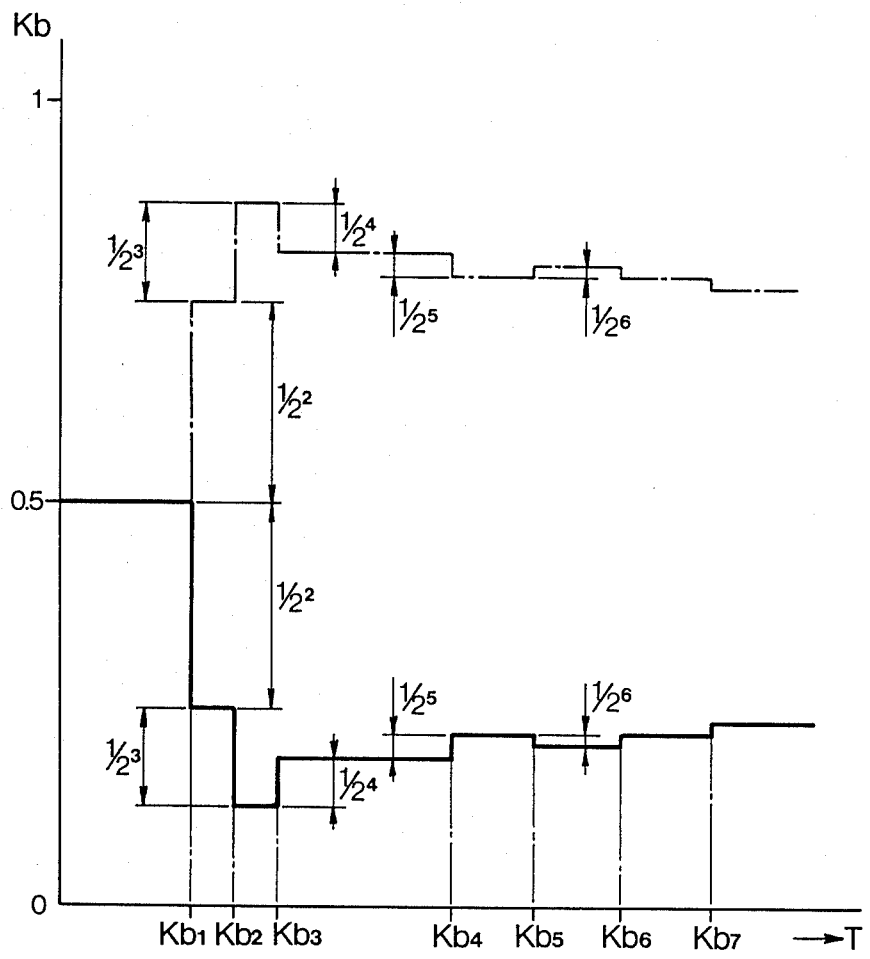
FIG. 7 is a graph showing updating steps of a learning coefficient.

FIG. 7 shows the above described learning operations.

From the foregoing, it will be understood that the present invention provides a system which updates the learning coefficient so that the deviation of the coefficient may be quickly reduced to an allowable value.

While the presently preferred embodiment of the present invention has been shown and described, it is to be understood that this disclosure is for the purpose of illustration and that various changes and modifications may be made without departing from the spirit and scope of the invention as set forth in the appended claim.

What is claimed is:

1. An air-fuel ratio control system for an automotive engine, comprising:

an $O_2$-sensor for detecting oxygen concentration of exhaust gas and for producing a feedback signal;

first means responsive to the feedback signal for producing an air-fuel ratio signal;

second means for producing a deviation signal representing the air-fuel ratio dependent on the air-fuel ratio signal from a desired air-fuel ratio;

a first lookup table storing a plurality of basic fuel injection pulse widths from which one of pulse widths is derived in accordance with engine operating conditions;

a second lookup table storing a plurality of maximum correcting quantities for correcting a derived basic fuel injection pulse width in order to correct deviation of air-fuel ratio due to change of a characteristic of a device used in the engine;

third means for producing a necessary correcting quantity by multiplying a learning coefficient and a derived maximum correcting quantity;

fourth means for producing a desired fuel injection pulse width in accordance with the necessary correcting quantity and the derived basic fuel injection pulse width;

fifth means for updating the learning coefficient with a correcting value when deviation represented by said deviation signal is out of an allowable range;

said correcting value being gradually reduced at every updating.

2. The system according to claim 1 wherein the engine operating conditions are intake-air pressure and engine speed.

3. The system according to claim 1 wherein the characteristic of a device is a valve clearance.

4. The system according to claim 1 wherein the correcting value is reduced by ½ at every updating.

* * * * *